US005862919A

United States Patent [19]

Eason

[11] Patent Number: 5,862,919

[45] Date of Patent: Jan. 26, 1999

[54] HIGH THROUGHPUT SORTING SYSTEM

[75] Inventor: Neal P. Eason, Newberg, Oreg.

[73] Assignee: SRC Vision, Inc., Medford, Oreg.

[21] Appl. No.: 728,615

[22] Filed: Oct. 10, 1996

[51] Int. Cl.[6] ..... B07C 5/00

[52] U.S. Cl. ..... 209/577; 209/585; 209/587; 209/639; 209/644; 209/939

[58] Field of Search ..... 209/576, 577, 209/585, 587, 639, 644, 939

[56] References Cited

U.S. PATENT DOCUMENTS

| | | | |
|---|---|---|---|
| 3,675,769 | 7/1972 | Story | 209/73 |
| 3,773,172 | 11/1973 | McClure et al. | 209/73 |
| 3,977,526 | 8/1976 | Gordon et al. | 209/639 X |
| 4,262,806 | 4/1981 | Drabs | 209/577 |
| 4,279,346 | 7/1981 | McClure et al. | 209/582 |
| 4,634,881 | 1/1987 | Billion | 250/572 |
| 4,723,659 | 2/1988 | Billion | 209/576 |
| 5,085,325 | 2/1992 | Jones et al. | 209/580 |
| 5,134,291 | 7/1992 | Ruhl Jr. et al. | 250/341 |
| 5,141,110 | 8/1992 | Trischan et al. | 209/524 |
| 5,440,127 | 8/1995 | Squyres | 250/341.8 |
| 5,443,164 | 8/1995 | Walsh et al. | 209/580 |
| 5,464,981 | 11/1995 | Squyres et al. | 250/341.8 |
| 5,520,290 | 5/1996 | Kumar et al. | 209/587 X |
| 5,529,169 | 6/1996 | Wilbur et al. | 209/576 |
| 5,683,000 | 11/1997 | Low | 209/639 X |

FOREIGN PATENT DOCUMENTS

| | | | |
|---|---|---|---|
| 0247016 | 5/1987 | European Pat. Off. | B07C 5/342 |
| 2430272 | 2/1980 | France | B07C 5/342 |
| 1301147 | 12/1989 | Japan | G01N 21/35 |
| 8500122 | 1/1985 | WIPO | B07C 5/34 |
| 9606689 | 7/1996 | WIPO . | |

OTHER PUBLICATIONS

NC State University, *UV/VIA/NIR Measurement Fundamentals*, Appendix 1, "Theory of Near Infrared Reflectance Spectroscopy," 1992.

The Infrared Information Analysis Center, Environmental Research Institute of Michigan, *The Infrared Handbook, Revised Edition*, Pages 3–13, 3–121, 3–129, 3–130, 1985.

*Primary Examiner*—David H. Bollinger
*Attorney, Agent, or Firm*—Stoel Rives LLP

[57] ABSTRACT

The sorting system provides a high degree of sorting accuracy even in high throughput sorting applications such as high speed wood chip sorting. In one embodiment, a sorting apparatus (10) includes a shaker (12) for distributing stock material, a spectrographic analyzer (14) for identifying unacceptable material in a product stream, an ejector (16) for diverting unacceptable material from the product stream, a three-zone sorting receptacle (18) and a recirculating system (20) for returning a selected portion of the sorter output for an additional pass by the analyzer (14) and ejector (16). The three-zone sorting receptacle (18) divides the product stream into an accept portion, a rejection portion, and an ambiguous portion including both acceptable product and unacceptable material. The ambiguous portion is re-sorted for improved accuracy at high throughput levels.

15 Claims, 1 Drawing Sheet

HIGH THROUGHPUT SORTING SYSTEM

FIELD OF THE INVENTION

The present invention relates generally to systems for removing unacceptable material from a product stream and, in particular, to a method and apparatus for sorting such a product stream so as to provide enhanced sorting accuracy and yield. The invention is particularly useful in high throughput sorting applications.

BACKGROUND OF THE INVENTION

Automatic sorting systems are generally utilized to sort unacceptable material from a product stream. For example, in the context of agricultural products, a product stream may be sorted to separate rocks, debris and unsatisfactory fruits, vegetables, tobacco and other unacceptable material from acceptable product. Similarly, automatic sorting systems are employed to separate unacceptable material from streams of wood chips, plastic materials and a variety of other commercial products.

Generally, such automatic sorting systems include a detector, such as a digital camera, for identifying unacceptable material and a sorting element for diverting the unacceptable material from the product stream, for example, mechanically or by using a compressed air blast. Ideally, the product stream is thereby bifurcated into a reject bin including only unacceptable material and an accept bin including only acceptable product. The overall effectiveness of a sorting system may be determined based on both accuracy (errors per quantity) and throughput (quantity per unit time).

Errors result from a number of factors. The case of sorting a wood chip stream using compressed air blasts is illustrative in this regard. The wood chip stream is typically transported through the inspection zone of the sorter at a high rate of speed. Additionally, the stream is typically distributed in an irregular or random pattern across the length and width of the belt, and unacceptable material is therefore often located in close proximity to acceptable product. Although the air blasts are closely controlled in order to minimize the potential for error, such blasts are finite in duration and disperse over distance. As a result, air blasts intended to divert unacceptable material from the product stream may also divert acceptable product thereby reducing yield. Similar problems are presented in a variety of other sorting applications.

In order to manage such error, operators commonly manipulate a number of system parameters such as operating speed and system geometry in order to achieve a balance of accuracy and throughput that is acceptable for each particular sorting application. In applications where very high purity is desired, e.g., sorting debris from food products, the system may be adjusted to sacrifice yield in favor of purity. However, this may result in waste. Where purity is less critical, e.g., sorting wood chips, the system may be adjusted to enhance throughput at the expense of purity. In many applications, achieving the desired product quality requires reducing throughput to levels where the financial viability of the sort is threatened. The continued and enhanced viability of automatic sorting systems for many applications depends on the ability to achieve high accuracy at high throughput levels.

SUMMARY OF THE INVENTION

The present invention allows for high accuracy, high throughput sorts by identifying a portion of the sorter output that indicates an ambiguity regarding acceptability. This ambiguous output portion can be re-sorted to enhance yield without unduly sacrificing sorting accuracy. The invention thus allows for high throughput sorts while maintaining an accuracy level that is acceptable for even various high purity applications, thereby enhancing the viability of automatic sorting systems.

According to one aspect of the present invention, a method is provided for dividing a moving product stream into three output portions, including an ambiguous output portion. The method includes the steps of conducting an analysis of the product stream to identify potentially unacceptable material, operating an ejector in response to the analysis to define a dispersed output, defining at least three zones relative to the dispersed output, collecting an output portion corresponding to one of the zones and subjecting the collected portion to further analysis. In one implementation of the invention, the three zones correspond to an undiverted portion of the product stream, a fully diverted portion and a partially diverted portion, where the last portion is collected for further analysis. It has been found that the portion of the stream that is only partially diverted is likely to include both acceptable product and unacceptable material, reflecting an ambiguity in the sorting system. This portion can be productively re-sorted.

According to another aspect of the present invention, a two-pass sorting process is implemented so as to allow for high throughput and high accuracy. In a first pass through the sorter, the product stream is separated into at least a first reject output portion and a second output portion for further consideration. In this regard, it has been found that a certain portion of the product stream can be identified as unacceptable in a single pass with a high degree of certainty. It is generally unproductive or even counterproductive to include such reject material in a second pass. After the first pass, at least a selected portion of the remaining product stream is directed through the sorter (the same sorter or another sorter) for a second pass. Preferably, the selected portion includes only an ambiguous output portion of the first pass, e.g., a partially diverted portion.

The apparatus of the present invention includes an analyzer for conducting an analysis of the product stream to identify unacceptable material, a sorting element for dispersing the product stream in response to the analysis and a collector for collecting a portion of the dispersed product stream that includes both acceptable product and unacceptable material so that the collected portion can be subjected to further analysis. The analyzer can include a digital camera and associated logic circuitry. The sorting element preferably includes a solenoid actuated puff-jet array. The apparatus can further include a conveyor for continuously transporting the collected output portion back to an input of the apparatus for a second pass. The invention thus allows for highly accurate sorts even at high throughput rates.

BRIEF DESCRIPTION OF THE DRAWING

For a more complete understanding of the present invention and further advantages thereof, reference is now made to the following Detailed Description taken in conjunction with the drawing, in which.

DETAILED DESCRIPTION OF THE INVENTION

Figure 1:
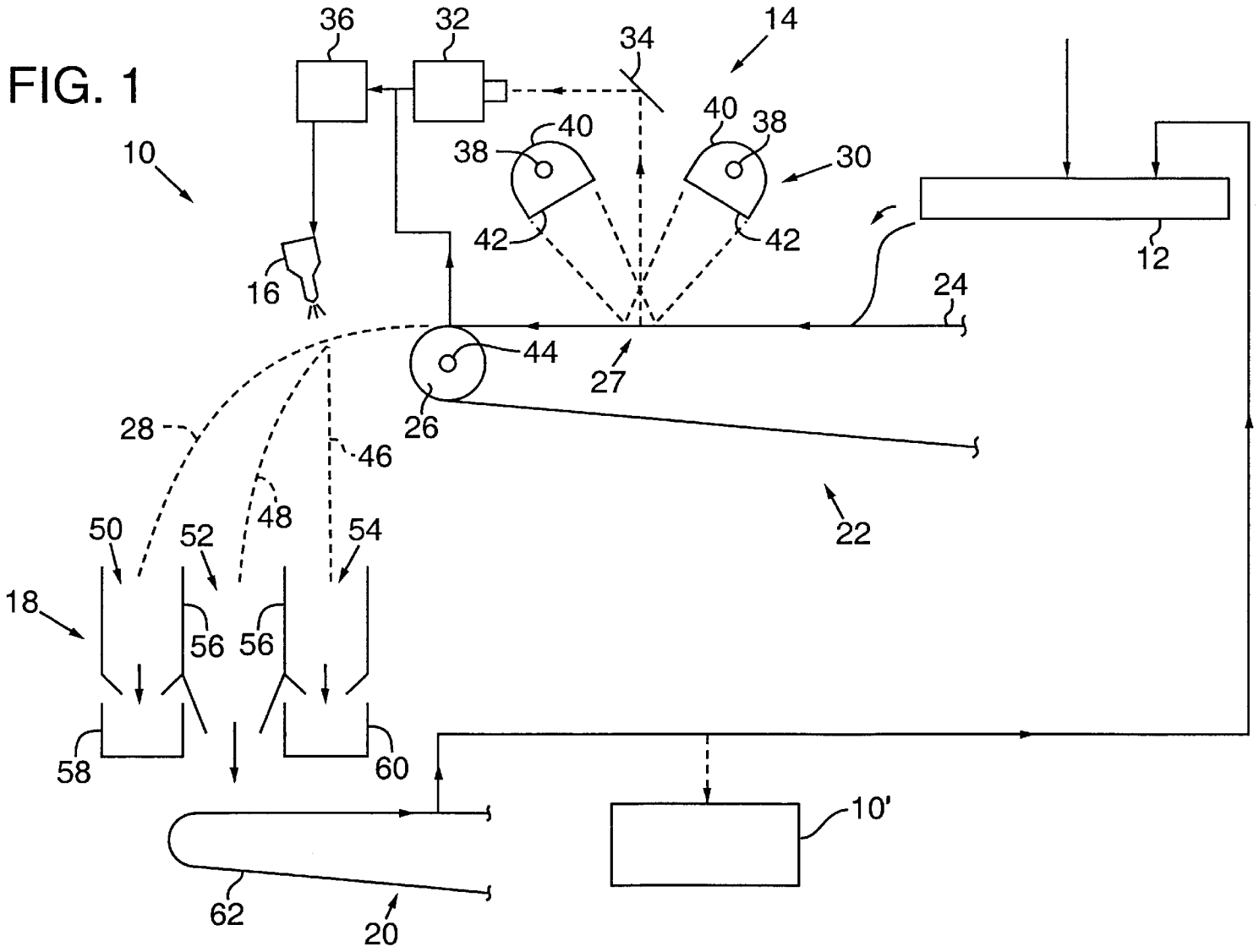
FIG. 1 is a side view showing a sorting system constructed in accordance with the present invention.

The sorting system of the present invention is useful in a variety of sorting applications relating to food, industrial and other products. In the following description, the invention will be set forth with respect to an exemplary embodiment for sorting wood chips. In order to provide a high quality product, wood chip stock is sorted prior to packaging in order to remove dirt, twigs, rocks and other debris, and to provide a wood chip product that is relatively uniform in color. This sorting process typically involves a series of mechanical and spectrographic sorting steps.

FIG. 1 shows a wood chip sorting apparatus 10 constructed in accordance with the present invention. Generally, the apparatus 10 includes a shaker 12, a spectrographic analyzer 14, an ejector 16 for diverting unacceptable material from the product stream, a three-zone sorting receptacle 18 and a recirculating system 20 for returning a selected portion of the output for an additional pass by the analyzer 14 and ejector 16.

Initially, the wood chip stock is introduced into the apparatus 10 by depositing the stock on the shaker 12. The shaker 12 reciprocates in a manner that distributes the stock across the width of the apparatus 10 so as to facilitate subsequent chip-by-chip analysis. If desired, a screening mechanism of suitable coarseness can be employed in conjunction with the shaker 12 to remove debris and improperly sized particles from the stock.

Upon exiting the shaker 12, the stock is deposited on conveyor mechanism 22. The conveyor mechanism 22 includes an endless belt 24 driven on rollers 26 at a controllable rate by a motor associated with a drive roller (not shown). The stock is transported by the belt 24 through an inspection zone 27 of the analyzer 14 to the ejector 16 thereby defining a product stream. As will be understood from the description below, the belt speed of the conveyor mechanism 22 is determined in conjunction with the positioning of the sorting receptacle 18 so that the wood chips will be projected along undiverted trajectory 28 into receptacle 18 unless diverted by ejector 16. The belt 24 preferably has a finish that is selected to minimize optical interference with operation of the spectrographic analyzer 14.

The analyzer 14 includes a pair of lamps 30 positioned on opposite sides of the inspection zone 27 for illuminating the wood chips, a camera 32, a mirror 34 for reflecting illumination from the inspection zone to the camera 32, and a processor 36 for processing an output signal from camera 32. Each lamp 30 includes an illumination source 38 housed within an elliptical reflector 40 so as to provide a strip of illumination in the inspection zone 27. A covering 42 is provided at the base of the reflectors 40 of the illustrated lamps 30 to protect the source 38 from debris or contaminants that could degrade performance or diminish lamp life. The type of source 38 employed can be selected to optimize the spectrographic analysis for specific applications. In the case of a wood chip sort, a fluorescent source for providing illumination in the visible spectrum, or an infrared source are typically utilized. Optical components (not shown) such as filters or polarizers, may be advantageously employed in conjunction with the lamps 30 and/or camera 32 for some applications.

The camera 32 detects incident reflected illumination and provides an output signal indicative of the intensity of the illumination and the associated location of the material on the belt 24. The illustrated camera 32, which may comprise a Cyclops camera manufactured by SRC Vision, Inc., is a digital camera having a high resolution detector plane, where the illumination sensitive pixels of the detector plane are optically mapped to corresponding locations of the inspection zone 27. The detector plane is read out on a periodic basis by appropriate data storage registers or the like. The output signal from camera 32 therefore includes substantially real-time intensity information on pixel-by-pixel basis.

The output signal from the camera 32 is transmitted to processor 36 which contains a microprocessor. The processor 36 also receives information regarding belt speed of the conveyor mechanism 22. Such speed information can be provided in any suitable form. For example, in the case of constant speed operation, a speed constant can be preprogrammed into processor 36. Alternatively, speed information can be obtained via an interface with a control panel or motor of the conveyor mechanism 22. Where a more positive feedback based indication is desired, a speed signal can be obtained from an encoder, for example, mounted on roller shaft 44.

Based on these inputs and predetermined criteria for distinguishing unacceptable material from acceptable product, the processor 36 identifies unacceptable material and controls operation of the ejector 16. In this regard, the processor 36 determines where the unacceptable material is located relative to the width of the belt 24 and synchronizes operation of the ejector 16 to movement of the unacceptable material so that the ejector 16 is activated at the appropriate time. Preferably, the ejector 16 can be activated for short time periods and at discrete locations spaced across the width of the belt 24 so that unacceptable material can be ejected from the product stream with reduced impact on any adjacent acceptable product. A variety of mechanical, pneumatic or other deflecting mechanisms can be used in this regard. The illustrated ejector 16 is a solenoid actuated linear array of puff-jets. Upon activation, each puff-jet provides a substantially instantaneous and highly localized compressed gas discharge sufficient to eject material from the product stream, as will be discussed in greater detail below. The processor 36 uses information regarding the location of the unacceptable material relative to the width of the belt 24 to determine which puff-jet of the array should be activated. The timing for activating the ejector 16 is determined mathematically based on knowledge of the relative positions of the inspection zone 27 and the ejector 16 and the belt speed of the conveyor mechanism 22. The processor 36 uses such timing information to implement an appropriate delay before transmitting an activation signal to the ejector 16.

Although these determinations are implemented with a great degree of care and accuracy, certain practical limitations—such as finite duration of the puff-jet blasts and puff-jet spacing, dispersion of the blasts and system tolerances—can result in errors in targeting unacceptable materials. In particular, it has been found that the ejector 16 tends to affect (or not affect) the product stream in three different manners as generally indicated by the illustrated undiverted trajectory 28, fully diverted trajectory 46 and partially diverted trajectory 48. The undiverted trajectory 28 is a free-fall trajectory that is unaffected by the ejector 16. Fully diverted trajectory 28 corresponds to a direct or solid blast from ejector 16. The partially diverted trajectory 48 represents a range of possibilities in between. Such partial diversions may result from imperfect targeting of unacceptable material or incidental diversion of acceptable product that was located closely adjacent to unacceptable material on belt 24. The partially diverted trajectory therefore represents an ambiguity regarding the acceptability of the associated material. The trajectories 28, 46 and 48 can be considered as collectively defining a dispersed sorter output.

As shown, the sorting receptacle 18 is divided into an accept chute 50, a recirculation chute 52 and a reject chute 54 by dividers 56 for respectively receiving material corresponding to undiverted trajectory 28, partially diverted trajectory 48 and fully diverted trajectory 46. The accept chute 50 and reject chute 54 deposit material into an accept hopper 50 and a reject hopper 60, respectively. The recirculation chute 52 deposits material onto a recirculation conveyor belt 62 for returning material to shaker 12 or to a second sorting apparatus 10' (shown in block diagram form in FIG. 1) to be re-sorted. With respect to the dispersed sorter output, portions closer to undiverted trajectory 28 are more likely to include acceptable product and portions closer to fully diverted trajectory 46 are more likely to include unacceptable material, whereas portions in between are likely to include both acceptable product and unacceptable material. Accordingly, the dimensions and positioning of the chutes 50–54 can be selected to provide an accuracy appropriate for a particular sorting application. In the illustrated embodiment, the chutes 50–54 are dimensioned and positioned to substantially divide the dispersed sorter output into thirds. Such an arrangement has been found to provide accuracy well in excess of the required product quality for wood chip applications even at belt speeds of 400–600 feet per minute.

While various embodiments and applications of the present invention have been described in detail, it is apparent that further modifications and adaptions of the invention will occur to those skilled in the art. However, it is to be expressly understood that such modifications and adaptations are within the spirit and scope of the present invention.

What is claimed is:

1. A method for use in sorting a moving product stream including both acceptable product and unacceptable material, said A method comprising the steps of:

conducting a first analysis of said moving product stream to identify potentially unacceptable material;

operating an ejector in response to said analysis, wherein said ejector is operative for diverting said potentially unacceptable material from said moving product stream and thereby defining a dispersed output of said moving product stream;

defining at least three zones relative to said dispersed output;

collecting a selected output portion corresponding to one of said three zones; and subjecting said selected output portion to a second analysis to identify potential defects.

2. A method as set forth in claim 1, wherein said step of conducting a first analysis comprises identifying potentially unacceptable material based on illumination reflected by said potentially unacceptable material.

3. A method as set forth in claim 1, wherein said step of conducting a first analysis comprises employing a camera to identify said potentially unacceptable material.

4. A method as set forth in claim 1, wherein said step of operating an ejector comprises directing a compressed air blast at said product stream.

5. A method as set forth in claim 1, wherein said step of defining at least three zones comprises positioning dividers relative to said dispersed output so as to define said three zones.

6. A method as set forth in claim 1, wherein said three zones correspond to an accept portion of said dispersed output including acceptable product, a reject portion including unacceptable material and said selected output portion and said step of collecting comprises positioning a compartment so as to receive said selected portion.

7. A method as set forth in claim 1, wherein said product stream comprises wood chips and said three zones include a first zone corresponding to a portion of said dispersed output including acceptable wood chips.

8. A method as set forth in claim 1, wherein said step of conducting a first analysis comprises transporting said product stream through an inspection zone of a sorter and said step of subjecting said selected output portion to a second analysis comprises transporting said selected portion a second time through an inspection zone of the same, or another, sorter.

9. An apparatus for use in sorting a moving product steam including both acceptable product and unacceptable material, said apparatus comprising:

first means for conducting an analysis of said product stream to identify potentially unacceptable material;

second means for dispersing said product stream in response to said analysis;

third means for collecting a selected portion of said dispersed product stream that includes both acceptable product and unacceptable material, said third means comprising a receptacle including a first compartment for collecting an acceptable product, a second compartment for collecting unacceptable material, and a third compartment for collecting said selected portion of said dispersed product stream; and a product recirculation system receiving and transporting said selected portion for further analysis so as to enhance sorting accuracy and yield.

10. An apparatus as set forth in claim 9, wherein said first means comprises a source of illumination for illuminating said product stream.

11. An apparatus as set forth in claim 9, wherein said first means comprises a camera directed at said product stream.

12. An apparatus as set forth in claim 11, wherein said first means comprises a processor associated with said camera for identifying unacceptable material based on information provided by said camera.

13. An apparatus as set forth in claim 9, wherein said second means comprises an ejector for selectively directing a compressed air blast at said product stream.

14. An apparatus as set forth in claim 9, wherein said third means is positioned in a center portion of said dispersed product stream.

15. An apparatus as set forth in claim 9, wherein said product recirculation system conveys said selected portion to said first means.

* * * * *